US007014014B2

(12) United States Patent
Mueller

(10) Patent No.: US 7,014,014 B2
(45) Date of Patent: Mar. 21, 2006

(54) SAFETY DEVICE FOR MONITORING A MOVABLE ELEMENT

(75) Inventor: Wolfgang T. Mueller, Radolfzell (DE)

(73) Assignee: ThyssenKrupp Aufzugswerke GmbH, Neuhausen (DE)

( * ) Notice: Subject to any disclaimer, the term of this patent is extended or adjusted under 35 U.S.C. 154(b) by 287 days.

(21) Appl. No.: 10/645,327

(22) Filed: Aug. 21, 2003

(65) Prior Publication Data

US 2004/0079591 A1 Apr. 29, 2004

Related U.S. Application Data

(63) Continuation of application No. PCT/EP02/01804, filed on Feb. 20, 2002.

(30) Foreign Application Priority Data

Feb. 22, 2001 (DE) ..... 201 03 158 U

(51) Int. Cl.
*B66B 5/04* (2006.01)

(52) U.S. Cl. ..... 187/305; 187/288; 187/293; 187/391

(58) Field of Classification Search ..... 187/247, 187/248, 391–394, 390, 397–399, 286–297, 187/305

See application file for complete search history.

(56) References Cited

U.S. PATENT DOCUMENTS 4,130,184 A * 12/1978 Satoh et al. ..... 187/295
4,308,936 A * 1/1982 Caputo et al. ..... 187/316
4,485,895 A * 12/1984 Tachino et al. ..... 187/293
4,586,587 A * 5/1986 Grossi et al. ..... 187/293
4,776,434 A * 10/1988 Caputo ..... 187/295
4,844,205 A * 7/1989 Klingbeil ..... 187/293
5,070,967 A * 12/1991 Katzy et al. ..... 187/297
5,869,794 A 2/1999 Spiess
6,089,355 A * 7/2000 Seki et al. ..... 187/292
6,170,614 B1 1/2001 Herkel et al.
6,227,334 B1 * 5/2001 Yumura et al. ..... 187/359

FOREIGN PATENT DOCUMENTS

WO 98/17575 4/1998

* cited by examiner

*Primary Examiner*—Jonathan Salata
(74) *Attorney, Agent, or Firm*—Lipsitz & McAllister LLC

(57) ABSTRACT

A safety device for monitoring a movable element, in particular, for elevators, is provided. The safety device includes a speed determination unit for determining the speed of the movable element, a comparator device for comparing a predetermined speed with the determined, actual value, a triggering unit for triggering a braking device, and a distance determination unit for determining the distance of the movable element in relation to a stationary or movable target. The comparator device comprises a memory for storing a maximum admissible speed and at least one nominal distance with an associated nominal speed. The comparator device compares a greatest stored nominal distance with an actual distance indicated by the distance determination unit. When the nominal distance is the same as the actual distance, the comparator device compares the nominal speed associated with the nominal distance with the actual speed registered by the speed determination unit at this point of time. When the nominal speed is exceeded the comparator device causes the triggering unit to emit an electronic triggering signal. The comparator device continuously compares the maximum admissible speed with the actual speed irrespective of nominal distances and when the maximum admissible speed is exceeded causes the triggering unit to emit the electronic triggering signal.

20 Claims, 4 Drawing Sheets

SAFETY DEVICE FOR MONITORING A MOVABLE ELEMENT

This application is a continuation of international application No. PCT/EP02/01804 filed on Feb. 20, 2002.

The present disclosure relates to the subject matter disclosed in International application No. PCT/EP02/01804 of Feb. 20, 2002, which is incorporated herein by reference in its entirety and for all purposes.

BACKGROUND OF THE INVENTION

The present invention relates to a safety device in accordance with the preamble to claim 1.

For safety reasons, the speed of an elevator car must be monitored in order to be able to initiate emergency braking in the case of any failure. This is carried out nowadays according to the state of the art by a speed governor which operates mechanically, is driven by a cable and triggers a braking device, such, as for example, a safety gear, via cables and rods in the case of an approximately 20% overspeed.

This system does, however, originate from the founder times of elevator construction and is inexact, liable to failures, triggers only with a certain delay and operates, in particular, in the case of soiling, aging as well as inadequate maintenance only unsatisfactorily.

For this reason, regular safety gear operation tests are prescribed for elevator cars which do, however, represent an unnecessary extreme load on the elevator, negatively impair its safety in the long term or can even lead to a destruction of important components of the elevator, such as, e.g., the gearing. In addition, it is a disadvantage of the mechanical speed governors known from the state of the art that, generally, it is hardly possible to reconstruct the procedure for the triggering of the safety gear.

It is, therefore, the object of the present invention to make a safety device available which avoids these disadvantages from the state of the art and, in particular, increases the safety of the systems monitored by the safety device. In addition, the operation and the construction of the safety device are intended to be more convenient or rather simpler. In particular, as short a reaction time as possible and a precise triggering of the safety device are also intended to be realized. An improved scope of design for the systems is also intended to be realized as a result of the increased safety of the monitored systems.

SUMMARY OF THE INVENTION

In order to be able to fulfill future requirements of elevator systems, such as higher speeds, shortened end areas of the shafts, temporary protection spaces as well as several cars in one shaft, it is also necessary to limit the speed as a function of the distance to a target. This includes, for example, the distance to the end of the shaft or the distance to another car in the same shaft. The safety device is also intended to take over these tasks.

These objects are accomplished by means of a safety device having the features of patent claim 1. Additional, advantageous developments are the subject matter of the dependent claims.

The inventive safety device is characterized, in particular, by the fact that it includes a distance determination unit, a speed determination unit and an intelligent comparator device, wherein the intelligent comparator device comprises a memory for storing a maximum admissible speed and at least one reference position (distance to the destination of the movable element) with, in particular, an associated intermediate speed, and wherein the distance determination unit, when a reference position is reached, indicates this to the comparator device which checks whether a maximum admissible intermediate speed is present for the reference position and, if this is the case, compares this with the actual speed registered by the speed determination unit at this point of time and when the intermediate speed is exceeded causes the triggering unit to emit an electronic triggering signal, and wherein the intelligent comparator device continuously compares the maximum admissible speed with the actual speed irrespective of reference positions and when the maximum admissible speed is exceeded likewise causes the triggering unit to emit an electronic triggering signal to trigger a braking device. In the case of several reference positions, these are processed according to the size of their distance from the destination.

As a result of the realization of the various units as electronic components or as virtual components with a microprocessor, the required maintenance is considerably reduced in comparison with a mechanical speed governor since the triggering signal to the braking device can also be advantageously transmitted without any contact. In addition, it is possible as a result of the speed limitation dependent on distance not only to monitor a limiting speed but also to monitor a plurality of speeds and even the courses of running characteristics as a function of the destination. This leads to a so-called multiple stage safety device which opens up a plurality of additional possibilities, such as, for example, the distance limitation in relation to another movable object in the shaft, a concerted test initiation in the case of low speeds or loads etc. Also, only one system is now needed for all the functions and speed ranges. In addition, a more concerted monitoring of the limiting speed in the acceleration and braking phase can be carried out as a result which improves and facilitates the operation and the construction of the entire system, e.g., with respect to more modest requirements for additional buffer zones in an elevator shaft.

For example, the elevator guidelines provide for buffer devices in a shaft pit. These have to be designed such that the car can run onto them unbraked with a nominal speed in the case of any failure without experiencing any damage. The greater the nominal speed of the elevator, the higher the buffer will be and, accordingly, the deeper the shaft pit must be. As a result of the introduction of a reduced nominal speed in the end area of the shaft, the buffers may be shortened to a standard size. Shaft pit and shaft head are accordingly smaller, the static requirements reduced.

An additional, reduced, second limiting speed does, however, presuppose a speed governor or safety device operating in two stages which automatically switches over to the lower speed when the car travels into the end area of the shaft and has reached a defined distance in relation to the end of the shaft.

For this purpose it is advantageous to provide, in addition, a position determination device and/or a direction indicator for determining the position and the direction of movement of the movable element to be monitored by the safety device. A multistage device controlled by position allows not only predetermined speeds, such as, e.g., the nominal speed, to be monitored but also braking and acceleration phases in accordance with the precalculated distance-speed characteristic curves and in the case of deviations to actuate a braking device, namely preferably the operating brake first of all and in the case of a negative result an emergency brake, such as, e.g., a safety gear, a short time later. The corresponding reference data from the normal distance-speed curve of the movable element to be monitored, for example, an elevator car, may be copied from the elevator control to the memory of the safety device or input into it separately. In addition, up-to-date data, for example, from an external information system, such as, e.g., a shaft information system in elevator systems, can be made available to the safety device.

For this purpose, it is advantageous to equip the safety device, in addition, with a data transmitting and/or receiving unit. As a result, it is possible, for example, to have several cars traveling in one shaft with a separate safety device associated with each of them. The data of each safety device are continuously exchanged with the neighboring car in a wireless or wire-bound manner. The safety device therefore recognizes its own position and that of the adjacent car. It continuously determines therefrom the distance to it. If the determined distance is less than a predetermined, stored reference value, the speed associated with this reference value is activated in addition and compared to the actual speed registered by the safety unit. When the reference speed is exceeded at the point of time when the reference distance is fallen short of, the safety device is triggered. As a result of this adaptive behavior, it is possible for several cars to move in one shaft in an optimum manner, e.g., they can also travel towards one another and the safety device intervenes only when travel states occur which are critical from a safety point of view.

The invention can also be used for carrying out the prescribed safety gear operation and buffer tests in a reduced speed range automatically and in a careful manner and for recording the result in a memory.

In addition, it is possible in the case of elevators without any pit and shaft head to establish a temporary protective area in that the elevator car associated with the safety device is intentionally tripped and stopped above the end of the shaft by pressing a button, controlled at a defined height and with a reduced speed.

There are several possibilities and variations for the construction of a multistage safety device which can monitor different speed limits. The multiple stages of the safety device can be brought about, for example, in that the previous, one-stage mechanical solution driven by cables is retained and supplemented or subsequently equipped with an electronic component or rather an electronic distance and speed limiting unit. The known, one-stage, mechanical speed governors have a mechanical triggering mechanism controlled by gravity and are, in the case of a combination with an electronic speed governor unit, provided for monitoring an absolute maximum speed. This means that the mechanical speed governor unit of a multistage, combined distance and speed governor is mainly provided for emergency operation and therefore increases the safety of the system considerably.

The safety-relevant data of the movable element monitored by the safety device, such as, for example, the elevator, as well as the data in the case of any failure, such as, for example, triggering speed, triggering point of time as well as delay in braking after triggering of the braking device, can be recorded in the memory provided in the safety device and are available for the analysis and reconstruction of all procedures.

The data may also be stored in a separate, encapsulated and sealed memory module and are overwritten again at a defined interval, for example, every 10 minutes.

In order to determine the speed of the movable element to be monitored, the safety device has, in accordance with the invention, a distance and speed determination unit. The realization of these units may be brought about in various ways, for example, separately or combined. For example, a pulse counter may be provided which registers the codings on an encoder disc which is driven by a cable, the drive disc or a friction wheel on the element to be monitored. Alternatively, it is also conceivable to use radar and/or laser sensors for the contact-free determination of distance and speed.

For the particularly quick and delay-free triggering of the braking device, a pyrotechnical final control element is provided in accordance with the invention as part of the triggering unit of the speed governor, the explosive charge of this element being ignited by an electronic triggering signal of the triggering unit. This pyrotechnical final control element can advantageously consist, for example, of a cylinder, in which a movable thrust or pressure piston is arranged, which is connected via linkage rods or a flexible connection to the braking device, e.g., a safety gear. The thrust or pressure piston is displaced in the cylinder pipe due to the igniting of the explosive charge and actuates the braking device with the linkage rods. This leads to a particularly quick reaction time of the brake. An additional improvement is achieved by using several explosive charges which are ignited automatically one after the other in the case of any faulty ignition.

The present invention with the electronically acting distance and speed governor using a pyrotechnical final control element leads, in particular, to a more precise and quick-reaction triggering as well as an increase in the reliability and reduction in maintenance. In addition, the equipment can be standardized and simplified. Furthermore, additional tasks can also be undertaken by the speed governor, such as, for example:

- multiple stages controlled by position, i.e., use of several triggering speeds/curves as a function of the section of travel and the position of the car in the shaft,
- adaptive distance protection when several cars are moving in one shaft,
- triggering dependent on the situation of safety gears acting parallel and serially,
- black box for recording and saving the relevant elevator data prior to and following the use of the speed governor with safety gear (time, speed, delays, braking distances, etc.).

This is realized, in particular, by the following features of the electronic safety device:

- storage of distances (1 to n), defined by the distance from position X to a stationary or movable target Y with reference points (1 to n) included therein which are again defined by a distance Z to the target and with which a respective reference speed is associated.
- doubling the distance Z while the movable target Y is moving towards the car
- optional wireless or wire-bound connections to stationary reference points 1-n installed in the shaft (contacts, magnetic switches, sensors etc.)
- continuous registering of the parameters time, position, destination, travel direction, speed as well as distance covered
- exchange of the relevant parameter data with the safety devices of adjacent elements to be monitored, such as, e.g., cages/cars in the same shaft (insofar as they are present) with a plausibility control of redundant data as well as the continuous determination of the distance between the adjacent cages or cars
- taking over the relevant actual data from the shaft information system taking over the relevant nominal data from the elevator control when a destination Y is present, selection of the relevant distance 1-n and when the first reference point is reached comparison of the associated reference speed with an actual speed and signaling and triggering the braking device when this is exceeded continuous storage of data relevant to safety.

Additional advantages, characterizing points and features of the present invention are apparent from the following, detailed description of embodiments on the basis of the attached drawings illustrating the embodiments in a completely schematic manner.

DETAILED DESCRIPTION OF THE INVENTION

Figure 1:
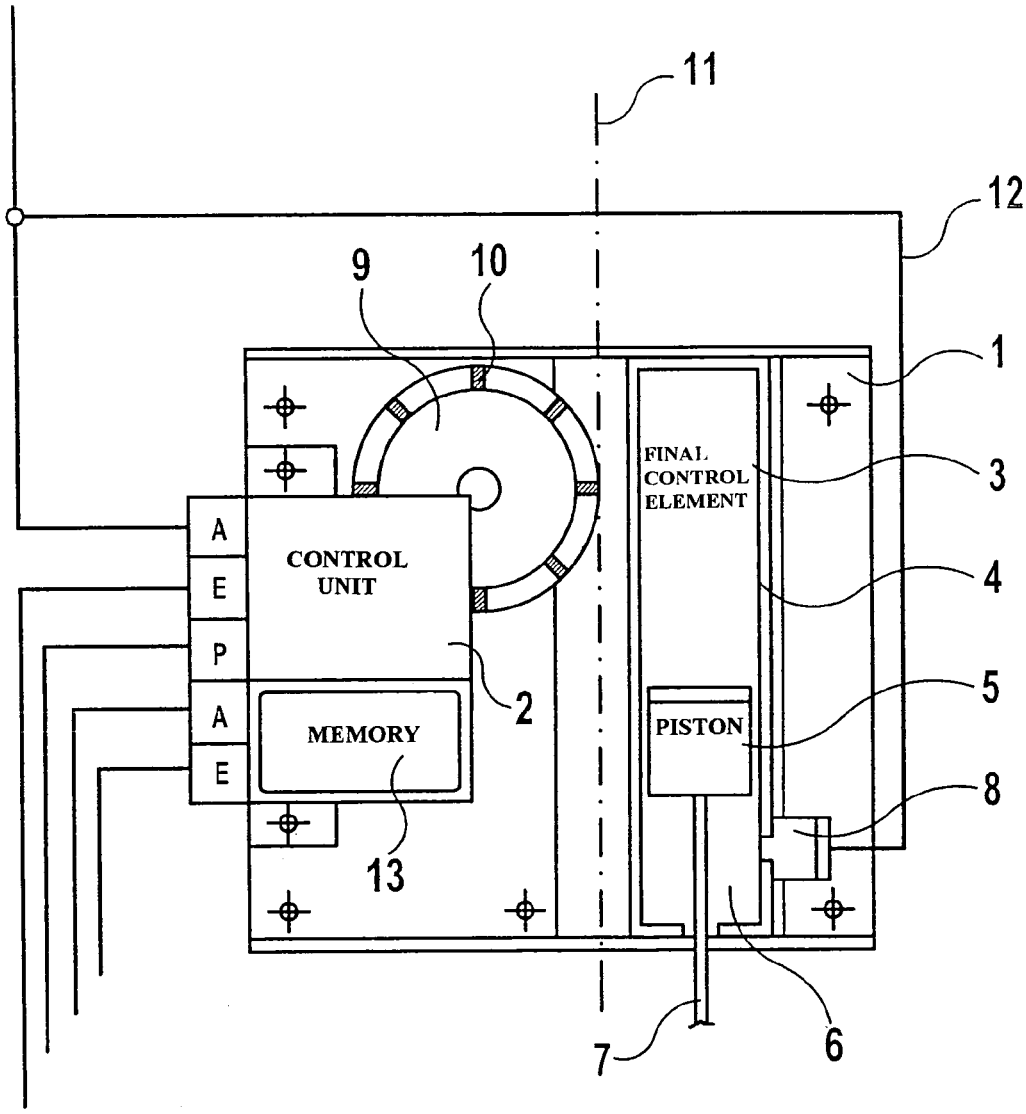
FIG. 1 shows a side view of an inventive safety device.

FIG. 1 shows a partially cutaway side view of an inventive safety device 1 which is composed of a row of functional units which are realized with the following constructional units. These include: An encoder disc 10 with a pulse counter and direction indicator, an electronic control unit 2 equipped with a microprocessor, memory, a virtual module, digital clock, a battery-buffered supply of energy, output units A with serial and parallel outputs, input units E with serial and parallel inputs as well as a plug-in type, sealed additional memory 13. In addition, there is a final control element 3, in this example according to pyrotechnical principles, for the mechanical actuation of the brake. Pulse generator, electronic control unit 2 and final control element 3 may also be set up in a spatially separate manner and be connected to one another by means of a wire-connected or wireless link, e.g., radio.

A simplified procedure for limiting only one maximum speed is as follows: If the electric control unit 2 establishes during a comparison of the determined actual speed with the maximum speed stored in the memory 13 that the maximum speed is being exceeded, an output unit A of the electronic control unit 2 transmits the triggering signal of the triggering unit via the line 12 to the ignition device 8 of the pyrotechnical final control element 3, whereby braking of the safety device or rather of the elevator car connected to it is initiated.

A series of additional functions is to be considered for the distance and speed limitation dependent on the destination.

The functional units include a distance determination unit, a speed determination unit, an intelligent comparator device and a triggering unit.

Speed Determination Unit:

The modules used by the speed determination unit comprise in the example, in addition, a friction wheel 9 which is pressed against a guide rail 11 with spring force and to which an encoder disc 10 is attached. The speed of the speed governor, which is arranged, for example, on an elevator car, can be determined during a rotation of the encoder disc 10 by means of a pulse counter and the digital clock which are arranged in the electric control unit 2.

Distance Determination Unit:

The distance determination unit uses, in principle, the same modules as the speed determination unit and, in the embodiment shown, is designed at the same time as a position determination unit. It determines the position of the car in the shaft, the distance to the stationary or movable target and a desired distance to the target. It requires for this purpose, in addition, precise reference points, e.g., at the beginning of the shaft and at the end of the shaft in the form of sensors, contacts or magnetic switches in order to signal the arrival of the car at the end destination point to the control unit 2. These end points P0 may be supplemented by additional intermediate destination points P1-n, e.g., for the stops in the shaft.

At the beginning of operations the distance determination unit measures the shaft in its entire distance as well as with all the existing intermediate distances with the pulse counter in a learning trip from P0 to P0 and stores these reference distances, marked, in the memory. If the car reaches P0 after the learning trip or during later operations, the pulse counter is set back to 0.

If the car is now given a destination during practical operations, for example, in order to travel from the lowest stop to floor 2, this call is passed to the elevator control and parallel to the distance determination unit. This reads the corresponding reference distance P0-floor 2 stored during the learning trip and deducts from this, when the car starts to move, the distance measured by the pulse counter. The distance covered results in the position of the car in relation to the beginning of the shaft and the remaining distance the distance to the actual destination. As a result, the distance or position determination unit knows at any point of time the position of the car in the shaft and the remaining distance to the destination. If a reversal in direction occurs, this is recognized by the direction indicator and the distance pulses are provided with the operational signs corresponding to the direction. If 2 cars are moving in the shaft independently of one another, each car receives from the distance or rather position and speed determination unit of the adjacent car position, direction of travel and speed transmitted in a wireless or wire-connected manner and continuously calculates from this the distance to the movable adjacent target.

Intelligent Comparator Device:

The intelligent comparator device keeps in the memory nominal speed values for distances which it reads from the memory by means of a software module as a function of the predetermined destination and compares them with the actual values supplied by the distance and speed determination unit. Predetermined nominal values are, for example, a distance 1-n to a destination x with an associated reference speed y. In a further refinement, the valid duration of the reference speed can again be defined as a point or distance.

If the comparator unit is given a destination, it searches in the memory to see whether a distance with or without a speed is present for this. The nominal distance is compared with the actual distance to the destination; if the distances are the same, a comparison of the nominal speed value with the actual speed takes place in addition. If the nominal speed is exceeded, a triggering signal is generated.

If the comparator unit is given a destination in relation to a mobile object, which is moving in the opposite direction, it doubles the stored nominal distance.

Triggering Unit as well as Data Transmitting and Receiving Unit:

The triggering as well as data transmitting and receiving unit contains several inputs which process control information and several outputs which are connected to the final control elements of the brakes. A software module allocates the triggering pulses of the comparator unit to the correct final control element in the correct sequence in time dependent on the control information.

Control information is, for example, the successful actuation of the final control element, the direction of travel and the speed of the car. If a pyrotechnical final control element 3 receives an ignition pulse via the line 12 and the final control element 3 does not acknowledge this within a time interval, a second ignition pulse is automatically sent on an additional, parallel output.

On account of the actual direction of travel, the transmitting unit allocates the triggering pulse to a brake acting upwards or downwards.

In the case of brakes arranged serially, the triggering unit triggers, for example, one or two brakes one after the other in accordance with the actual speed.

Final Control Element:

Various designs are possible for the conversion of an electric pulse into a mechanical actuating force. The following example shows a pyrotechnical principle. The pyrotechnical final control element 3 consists of a cylinder 4 and a piston 5 which is displaceable in the cylinder and is connected to the braking device which is not illustrated via linkage rods or a flexible connection 7. If the triggering signal is transmitted to the ignition device 8 by the electric control unit 2, the explosive charge located in the ignition device is ignited and the piston 5 is moved in the cylinder 4 accordingly.

A sensor preferably provided on the pyrotechnical final control element 3 registers the actuation of the pyrotechnical final control element 3 and notifies the electronic control unit 2 of this. The triggering unit of the electric control unit 2 transmits ignition signals at defined time intervals for such a time until the confirmation of actuation has been transmitted by the pyrotechnical final control element. The number of ignition commands transmitted and the feedback from the sensor can be stored in an additional memory or a memory area of the memory 13. In addition, the ignition status can also be transmitted to the elevator control and the elevator is deemed, for example, to be out of order for such a time until the number of the resulting ignition commands is set back to zero in the case of a renewal of the used ignition charges.

Figure 2:
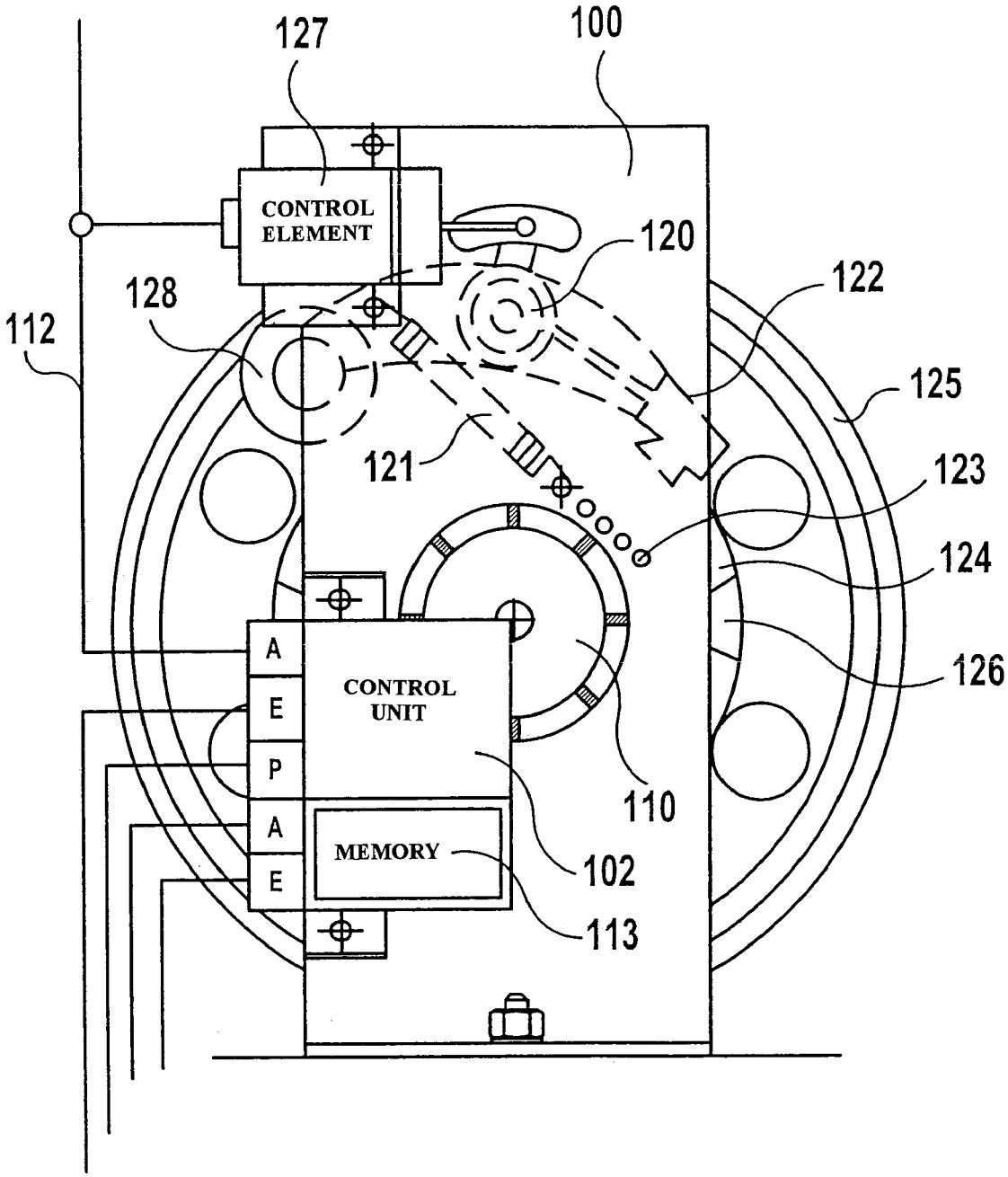
FIG. 2 shows a side view of an additional embodiment of an inventive safety device.

FIG. 2 shows in a similar illustration to that of FIG. 1 an additional embodiment of an inventive safety device 100. The safety device 100 differs from the safety device 1 of the previous embodiment in that it is constructed in a combined, multistage manner, in particular, in a combined two-stage manner, wherein one stage of the safety device 100 is realized by means of a conventional mechanical speed governor unit. Multiple stages means in this conjunction that not only can a maximum speed be monitored but also several different speeds can be monitored which are graded, in particular, in accordance with the situation of their use. Whereas this can be realized in the preceding embodiment which is illustrated in FIG. 1 in a simple manner in that the different speeds to be monitored are stored in the memory 13 as a function of the destination and the distance and the electronic control unit 2 monitors the different speeds as a function of the determined or transmitted position and movement data, an additional, mechanical speed governor unit is provided in the embodiment of FIG. 2 and this monitors an absolute maximum speed value. Combined multiple stages means that the stages are different, i.e. realized electronically or mechanically.

The mechanical speed limiting unit of the safety device 100 comprises a disc 125 driven by a cable in a known constructional manner. An additional, multi-edged disc 124 is attached to it. A rocker means 120 is, on the other hand, mounted above this disc. The one arm of the rocker means 120 ends in a roller 128 which is pressed with an adjustable spring 121 onto the multi-edged disc 124. The other end of the rocker means 120 ends in a detent 122. When the rotational speed of the speed governor is increased, the abutting arm with the roller 128 lifts away when the maximum limit speed to be monitored is reached to such an extent, controlled by gravity, until the other arm engages in a nipple 126 on the disc 124 which is shaped like a dovetail and, therefore, blocks the speed governor 100.

The rocker means 120 can be adjusted to different limiting speeds by means of the spring tension acting on it as a result of the spring engaging openings 123 which are arranged differently.

The rocker means 120 likewise serves for the actuation of the braking device via the electronic speed governor unit of the safety device 100 which corresponds essentially to the embodiment of the safety device 1. Instead of the pyrotechnical final control element 3 in the case of the safety device 1 according to the embodiment of FIG. 1, the triggering signal of the electronic control unit 102 of the safety device 100 is transmitted via an output unit A and a corresponding cable connection 112 to an electronically actuatable final control element 127 which, when actuated, actuates the rocker means 120.

As a result of the provision of an additional mechanical speed governor unit independent of the electronic speed governor unit, the safety of the safety device 100 is increased since, when one system fails, the other one still triggers at least when the absolute maximum speed is exceeded.

Figure 3:
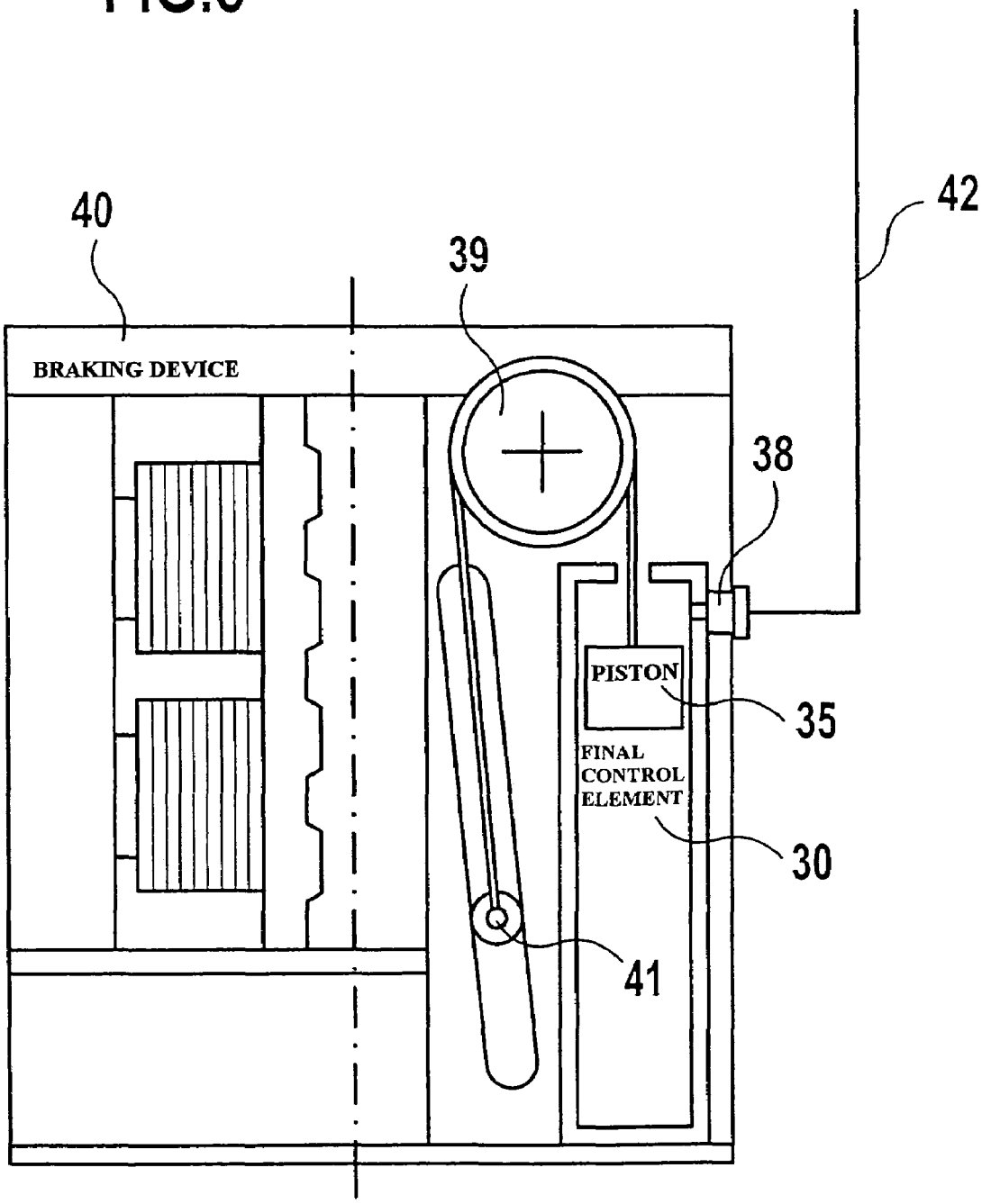
FIG. 3 shows a lateral sectional view of a braking device with a pyrotechnical final control element.

FIG. 3 shows in a partially cutaway side view the integration of a pyrotechnical final control element 30 in a braking device 40.

The piston 35 of the pyrotechnical final control element 30 is driven via the ignition of the ignition charge 38 by means of a triggering signal transmitted via the line 42 and so the safety gear triggers the braking procedure via the deflection roller 39 and the actuation of the sliding block 41.

This embodiment is particularly advantageous when a safety device 1 is used centrally for several safety gears and, for example, is arranged on the drive disc of an elevator. In this case, separate final control elements 30 are, namely, necessary at least for each direction of travel. A centrally arranged safety device 1 can be used centrally for safety gears which act upwards or downwards and can trigger the corresponding safety gears or braking devices dependent on the situation. In this respect, the safety gears with an integrated final control element 30 in accordance with the embodiment of FIG. 3 can be connected in parallel or in a row. In this way, it is possible to control different speed and load instances better and to design the braking delay so to be gentler. If several safety gears 40 are connected in a row, each includes its own final control element 30. The triggering pulses then pass to the individual final control elements 30 in a time-controlled manner via preferably parallel output units A of the electronic control unit 2 in order to generate the desired braking reaction in accordance with the state of travel of the car.

In order to increase the safety further, the safety gears of the adjacent cars can also be co-controlled in the case of any failure, for example, via radio or wire links. Since, in general, each car has its own safety device, a redundant double function results. However, it is then necessary to evaluate the data of the elevator control and the data of the shaft information system in addition.

Figure 4:
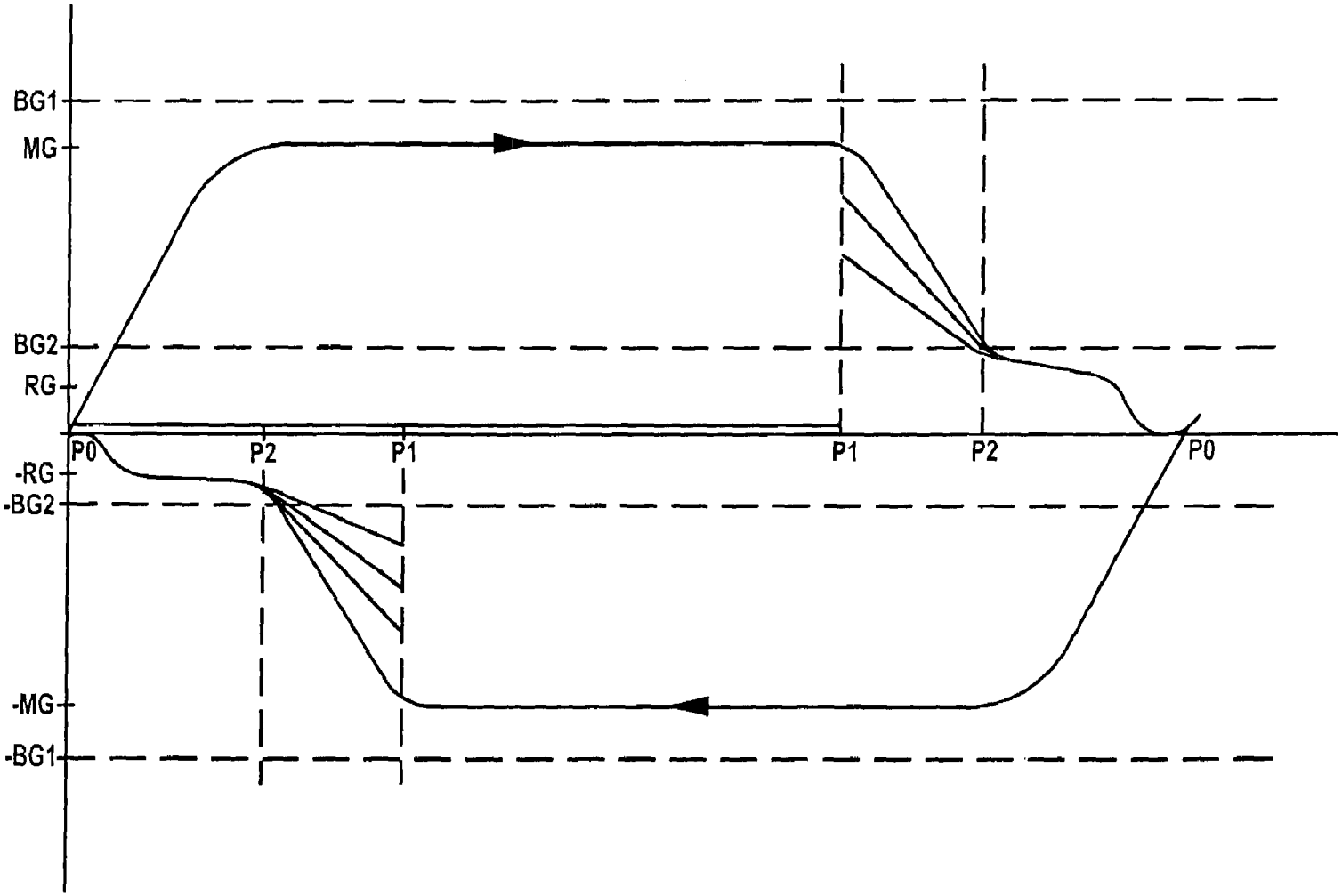
FIG. 4 shows a distance-speed diagram of an elevator with different limiting speeds.

FIG. 4 shows in a distance-speed diagram a simple use for a multistage safety unit 1 or 100 in accordance with the present invention. If, for example, an elevator car moves on the path P0-P0 with the speed MG, the limiting speed BG1 is, on the one hand, monitored by the safety device, a braking procedure being initiated when this is exceeded. In addition, a second limiting speed BG2 is monitored, namely dependent on the distance. Shortly before reaching the destination P0 the elevator car must be braked to the speed RG. If the safety device ascertains at the position P2 that the elevator car has a higher speed (BG2) than the nominal speed RG, a braking procedure is likewise initiated. The reference point P2 must be selected such that when the limiting speed BG2 is exceeded the triggered braking device can stop the car prior to the end of the shaft.

What is claimed is:

1. Safety device for monitoring a movable element, in particular, for elevators, comprising:

a speed determination unit for determining the speed of the movable element, a comparator device for comparing a predetermined speed with the determined, actual value, a triggering unit for triggering a braking device, and a distance determination unit for determining the distance of the movable element in relation to a stationary or movable target, wherein:

the comparator device comprises a memory for storing a maximum admissible speed and at least one nominal distance with an associated nominal speed, the comparator device compares a greatest stored nominal distance with an actual distance indicated by the distance determination unit; and when the nominal distance is the same as the actual distance, the comparator device compares the nominal speed associated with the nominal distance with the actual speed registered by the speed determination unit at this point of time;

when the nominal speed is exceeded the comparator device causes the triggering unit to emit an electronic triggering signal; and the comparator device continuously compares the maximum admissible speed with the actual speed irrespective of nominal distances and when the maximum admissible speed is exceeded causes the triggering unit to emit the electronic triggering signal.

2. Safety device as defined in claim 1, wherein the speed determination unit comprises a pulse counter registering the codings on an encoder disc driven with a speed to be registered via a friction wheel or a cable.

3. Safety device as defined in claim 1, wherein at least one of the distance determination unit and speed determination unit comprises at least one of radar and laser sensors.

4. Safety device as defined in claim 1, further comprising:

at least one of a position determination device for determining the position of the movable element and a direction indicator for determining the direction of movement.

5. Safety device as defined in claim 4, wherein the distance determination unit, the position determination device and/or the direction indicator use and/or exchange with one another the data generated by the speed determination unit.

6. Safety device as defined in claim 1, wherein:

the memory is able to store nominal distances with a respectively associated nominal speed as a function of respective destinations, the comparator device is given the destinations and in accordance with a selected destination reads out the respective nominal distances with associated nominal speeds for the nominal-actual comparisons, and the comparator doubles the nominal distance in the case of two movable elements traveling towards one another in the same shaft.

7. Safety device as defined in claim 6, wherein:

the distance determination unit is designed such that it is able to register the position, direction and the distance of the movable element in relation to a stationary or movable target, and safety distances with associated maximum speeds stored in the memory are called up dependent on the destination, the triggering signal being activated when said safety distances are exceeded.

8. Safety device as defined in claim 1, wherein the triggering unit comprises a pyrotechnical final control element, said element being triggered by the electronic triggering signal.

9. Safety device as defined in claim 8, wherein the pyrotechnical final control element comprises:

a tube with a built-in thrust or pressure pistons, and at least one explosive charges ignitable electrically, and a sensor for sensing actuation of the final control element.

10. Safety device as defined in claim 8, wherein the pyrotechnical final control element is integrated in a housing with at least one of the speed determination unit, the distance determination unit, the comparator device, the position determination unit and the triggering unit or integrated in the braking device to be actuated.

11. Safety device as defined in claim 1, wherein:

the safety device is constructed with at least two stages, and a speed governor unit with at least a second independent speed determination unit and a second comparator device is provided.

12. Safety device as defined in claim 11, wherein:

the speed governor unit is formed by a conventional mechanical speed governor driven by a cable, and said governor monitors and limits the maximum speed.

13. Safety device as defined in claim 12, wherein:

the triggering unit comprises a rocker means for triggering a braking device, and said braking device is activated, on the one hand, by means of the mechanical speed governor unit and, on the other hand, by an electrically actuatable final control element.

14. Safety device as defined in claim 1, further comprising:

a data transmitting and/or receiving unit exchanging position and movement data with an external information system, said external information system comprising a shaft information system with position sensors in the elevator shaft or adjacent safety devices.

15. Safety device as defined in claim 1, the braking device further comprises:

at least one of safety brakes and instantaneous safety gears for both directions of travel.

16. Safety device as defined in claim 1, further comprising:

a test device adapted to trigger the braking device as a trial in a predetermined position and/or speed of the movable element.

17. Safety device as defined in claim 1, wherein:

the triggering unit is adapted to be activated in a remote-controlled manner, and a second rocker means is provided for the remote triggering, said rocker means being offset, in particular, through 180°.

18. Safety device as defined in claim 1, wherein:

the safety device has a backup memory for separately saving data relevant to safety said data stored in said backup memory being updated at intervals.

19. Safety device as defined in claim 1, further comprising:

an emergency supply of energy in the form of a battery.

20. Safety device as defined in claim 1, further comprising:

a storage unit for storing operational data, said operational data including the number of triggering commands to a pyrotechnical final control element.

* * * * *

UNITED STATES PATENT AND TRADEMARK OFFICE

CERTIFICATE OF CORRECTION

PATENT NO. : 7,014,014 B2
APPLICATION NO. : 10/645327
DATED : March 21, 2006
INVENTOR(S) : Mueller It is certified that error appears in the above-identified patent and that said Letters Patent is hereby corrected as shown below:

Column 10, line 37

Delete the "s" at the end of the word "pistons".

Signed and Sealed this

Twenty-fifth Day of July, 2006

JON W. DUDAS
*Director of the United States Patent and Trademark Office*